US007303102B2

(12) United States Patent
Werts

(10) Patent No.: US 7,303,102 B2
(45) Date of Patent: Dec. 4, 2007

(54) CARRYING APPARATUS

(76) Inventor: Minetta L. Werts, 3749 Beeson Dairy Rd., Winston-Salem, NC (US) 27105-9778

( * ) Notice: Subject to any disclaimer, the term of this patent is extended or adjusted under 35 U.S.C. 154(b) by 524 days.

(21) Appl. No.: 10/928,055

(22) Filed: Aug. 27, 2004

(65) Prior Publication Data

US 2006/0043136 A1 Mar. 2, 2006

(51) Int. Cl.
*A45F 3/14* (2006.01)

(52) U.S. Cl. ..... 224/607; 224/250

(58) Field of Classification Search ..... 224/607, 224/250, 257, 628, 246; 294/150, 157, 149, 294/156, 138; 242/170; 24/17 A, 191, 17 R, 24/196

See application file for complete search history.

(56) References Cited

U.S. PATENT DOCUMENTS 675,318 A * 5/1901 Boothe ..... 24/17 A
734,934 A 7/1903 Palmer
925,986 A 6/1909 Blackburn
1,082,017 A * 12/1913 Feinan ..... 224/250
1,663,708 A * 3/1928 Keeler ..... 294/149
3,865,292 A 2/1975 Foley
3,923,222 A 12/1975 Groves
4,116,374 A * 9/1978 Garello ..... 294/150
4,156,498 A * 5/1979 Miller ..... 294/151
4,754,996 A * 7/1988 Tecca et al. ..... 294/151
5,645,307 A 7/1997 Wengler
5,879,041 A 3/1999 Sutherland
D410,335 S 6/1999 Raich
D412,057 S 7/1999 Brown
D434,295 S 11/2000 Liang
6,237,796 B1 5/2001 Murphy, Jr.
D451,281 S 12/2001 Wodkowski et al.
D460,620 S 7/2002 Smithey
6,446,849 B1 9/2002 Schleifer
6,467,661 B1 10/2002 Mistretta et al.
6,499,197 B1 12/2002 Huang
6,648,301 B2 11/2003 Lee
6,648,381 B2 11/2003 Holton et al.

* cited by examiner

*Primary Examiner*—Nathan J. Newhouse
*Assistant Examiner*—Margaret Olson
(74) *Attorney, Agent, or Firm*—Adams Evans P.A.

(57) ABSTRACT

A carrying apparatus for carrying objects, such as books. The carrying apparatus includes an elongate strap for being wrapped around an object and at least one direction-changing device positioned on a side of the object. The elongate strap is threaded through the at least one direction-changing device to form a pocket for receiving and securing the object in a carrying position.

16 Claims, 7 Drawing Sheets

CARRYING APPARATUS

TECHNICAL FIELD AND BACKGROUND OF THE INVENTION

This invention relates to an apparatus for carrying objects, such as books, and more particularly to a strap direction changing device for carrying books using a single strap.

Today book bags, such as those produced by JANSPORT, Inc., are the book carrying apparatus of choice. However, these book bags allow an individual to conceal items within the book bag. As a result, book bags have been used to bring weapons and other prohibited paraphernalia into schools, businesses, and other public locations undetected.

It is known to use straps to carry objects such as books. For example, U.S. Pat. No. 734,934 to E. B. Palmer discloses a parcel strap apparatus. The parcel strap consists of two straps, a longitudinal strap and a transverse strap. Buckles are used to secure the straps in an adjusted position around an object. A washer having slits is used to interconnect the two straps at a bottom of the parcel strap assembly. The longitudinal strap is longer than the transverse strap to provide a handle for carrying the parcel strap and secured object.

U.S. Pat. No. 3,865,292 to Foley discloses a book strap. The book strap is formed from three elastic elongate strips. The strips are secured to each other at a center point by a fastener such as a rivet. The straps are wrapped around a book and secured on a bottom side of the book by a ring and a plurality of hooks positioned on the ends of the straps.

While these devices accomplish the purpose of carrying objects, they require more than one strap to form a pocket around a book or other object. In addition, securing devices, such as buckles, rivets, stitching, and hooks are required to secure the straps together.

Accordingly, there is a need for a book carrying apparatus that eliminates the possibility of concealing weapons while reducing the complexity of multiple strap carrying apparatuses.

SUMMARY OF THE INVENTION

Therefore, it is an object of the invention to provide a carrying apparatus that does not allow an individual to conceal weapons or other prohibited paraphernalia.

It is another object of the invention to provide a carrying apparatus that uses a single strap to form a pocket around objects, such as books.

It is another object of the invention to provide a carrying apparatus that allows the strap to be adjusted according to the size of the object being carried.

It is another object of the invention to provide a carrying apparatus that uses a direction-changing device to prevent the strap from binding.

These and other objects of the present invention are achieved in the preferred embodiments disclosed below by providing a carrying apparatus. The carrying apparatus includes at least one direction-changing bracket for being positioned on a side of an object; and an elongate strap for being wrapped around the object, wherein the strap is threaded through the direction-changing bracket to form a pocket for receiving and securing the object in a carrying position.

According to another preferred embodiment of the invention, the carrying apparatus further includes a securing means for securing the strap in a selected position relative to the direction changing bracket.

According to another preferred embodiment of the invention, the securing means includes a movable bar for clamping the strap against an end plate.

According to another preferred embodiment of the invention, the securing means further includes a top plate, at least one spring, and the bar attached to the top plate, and wherein the at least one spring is positioned between the top plate and an end plate of the direction-changing device for providing an upward force on the top plate forcing the bar to engage the strap and securing the strap.

According to another preferred embodiment of the invention, the direction-changing bracket is defined by a first L-shaped section and an attached second inverted L-shaped section.

According to another preferred embodiment of the invention, each of the L-shaped sections include a vertical section and a horizontal section, and at least one guide is disposed at the intersection of the vertical and horizontal sections, the guide being disposed at an angle which allows the strap to change directions without binding.

According to another preferred embodiment of the invention, the guide is selected from the group consisting of a roller, a rod, a pin, and a bar.

According to another preferred embodiment of the invention, the strap forms a loop around the guide to define first and second mutually perpendicular strap sections.

According to another preferred embodiment of the invention, the direction-changing bracket includes a plurality of cross-members which define a channel for receiving the strap.

According to another preferred embodiment of the invention, the strap is positioned relative to the direction-changing bracket to define a shoulder loop for allowing an individual to carry the carrying apparatus over a shoulder.

According to another preferred embodiment of the invention, a carrying apparatus includes at least two spaced-apart direction-changing devices for being positioned on opposing sides of an object; and an elongate strap for being wrapped around the object, wherein the strap is threaded through the direction-changing devices to form a pocket for receiving and securing the object in a carrying position.

According to another preferred embodiment of the invention, the carrying apparatus further includes a tensioner for securing the strap in a selected position relative to the direction changing device.

According to another preferred embodiment of the invention, the tensioner includes a movable bar for clamping the strap against an end plate.

According to another preferred embodiment of the invention, the tensioner further includes a top plate, at least one spring, and a bar attached to the top plate, and wherein the at least one spring is positioned between the top plate and an end plate of a respective one of the at least two spaced-apart direction-changing devices for providing an upward force on the top plate forcing the bar to engage the strap and securing the strap.

According to another preferred embodiment of the invention, the direction-changing devices are defined by a first L-shaped section and an attached second inverted L-shaped section.

According to another preferred embodiment of the invention, each of the L-shaped sections include a vertical section and a horizontal section, and at least one guide is disposed at the intersection of the vertical and horizontal sections, the guide being disposed at an angle which allows the strap to change directions without binding.

According to another preferred embodiment of the invention, the guide is selected from the group consisting of a roller, a rod, a pin, and a bar.

According to another preferred embodiment of the invention, the strap forms a loop around the guide to define first and second mutually perpendicular strap sections.

According to another preferred embodiment of the invention, the direction-changing devices include a plurality of cross-members which define a channel for receiving the strap.

According to another preferred embodiment of the invention, the strap is positioned relative to the -direction-changing devices to define a shoulder loop for allowing an individual to carry the carrying apparatus over a shoulder.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
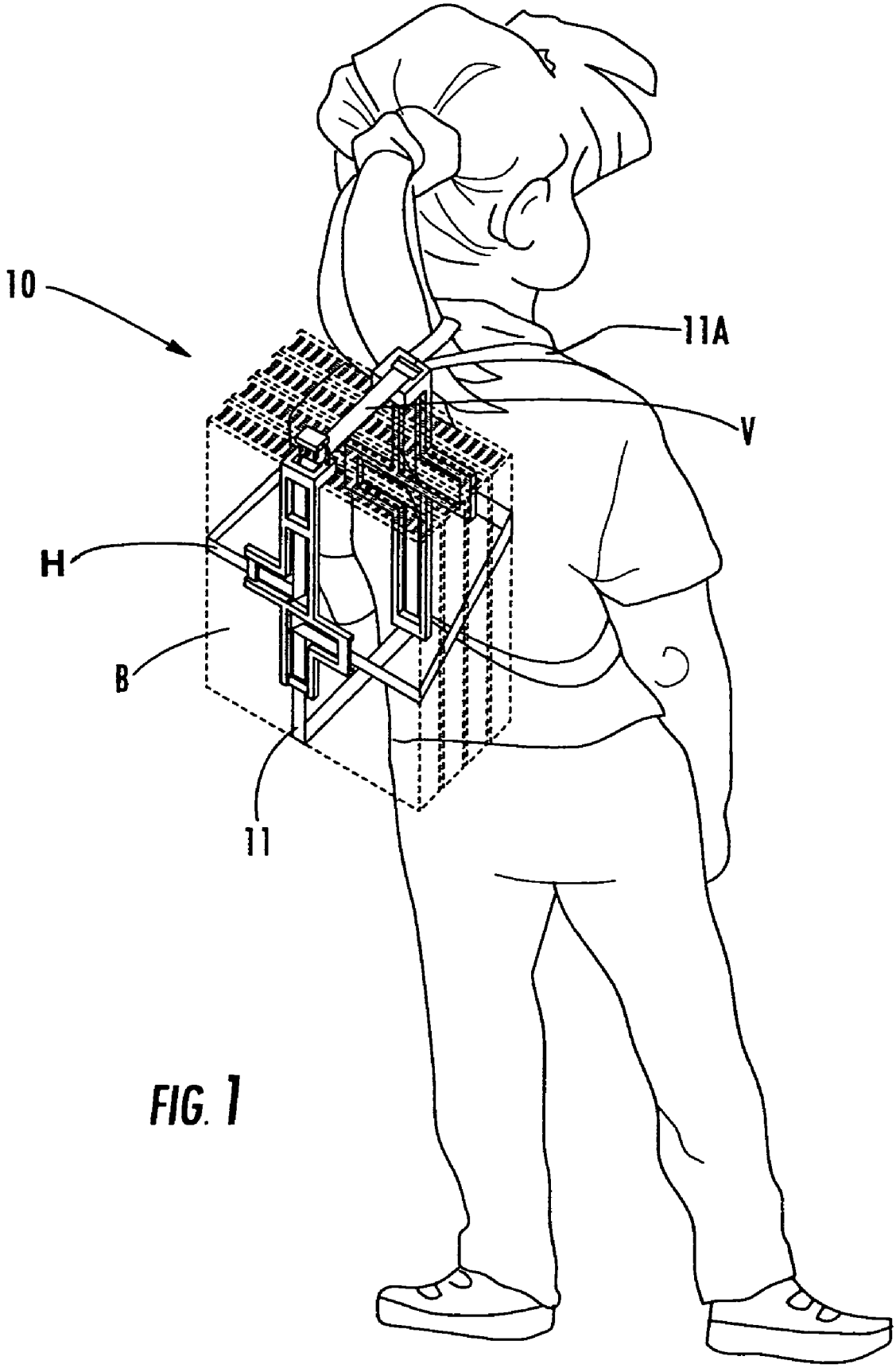
FIG. 1 shows a perspective view of a child carrying a plurality of books using the book carrying apparatus of the present invention.
Figure 2:
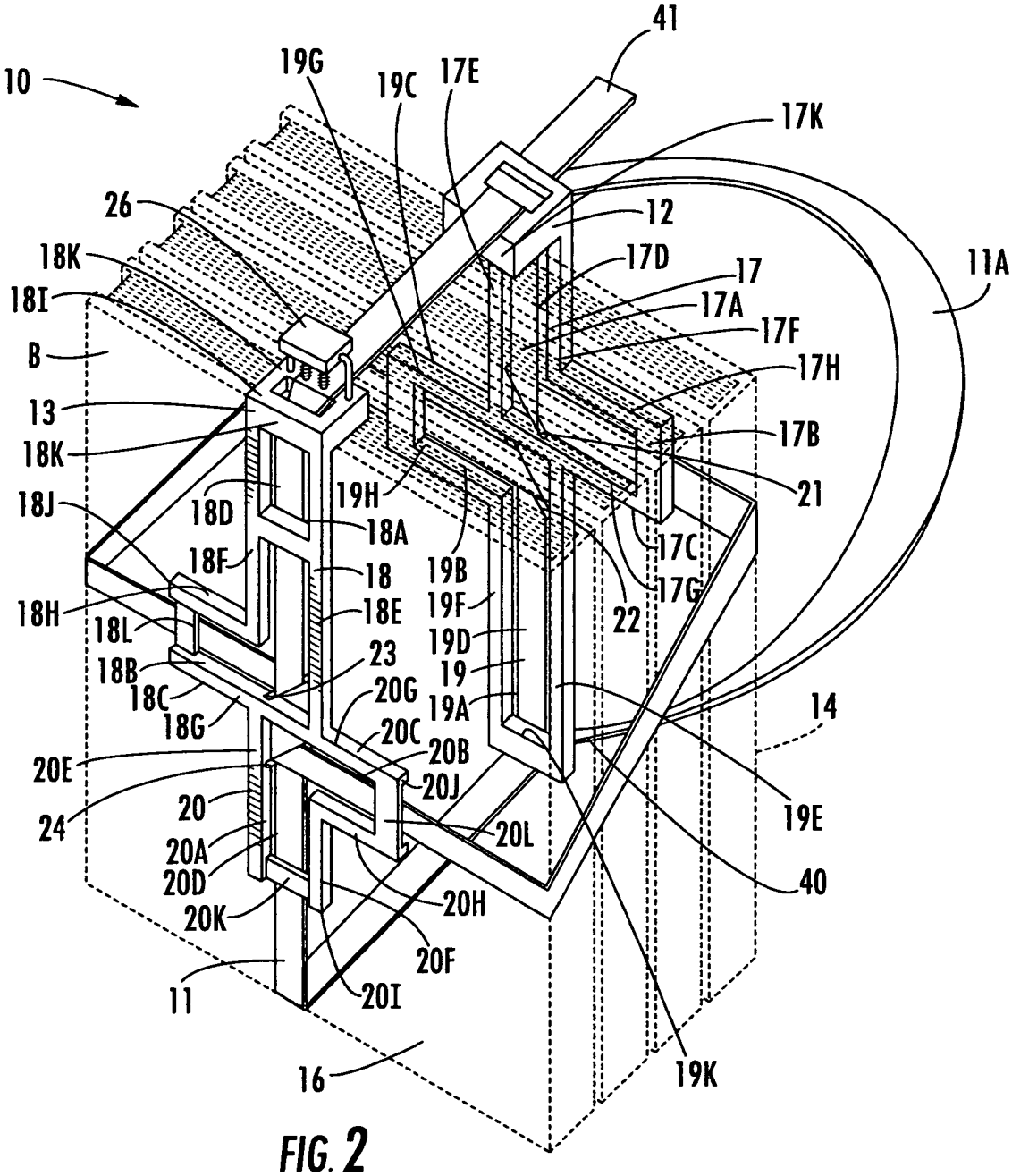
FIG. 2 shows a perspective view of a book carrying apparatus constructed in accordance with the present invention.

Referring now specifically to the drawings, a carrying apparatus of the present invention is illustrated in FIGS. 1 and 2 and shown generally at reference numeral 10.

The carrying apparatus 10 comprises a single elongate strap 11 which is threaded through a pair of spaced-apart direction-changing brackets 12 and 13 to form a pocket around books or other objects. The term "pocket" as used herein refers to a volume enclosed by a generally horizontal loop "H" and a generally vertical loop "V" formed by the straps 11 when it is threaded through the direction-changing brackets 12 and 13. The strap 11 also defines a shoulder loop 11A. It should be appreciated that a second elongate strap (not shown) could be attached and run along with the strap 11 to provide a book carrying apparatus with two shoulder loops for easier carrying.

Figure 4:
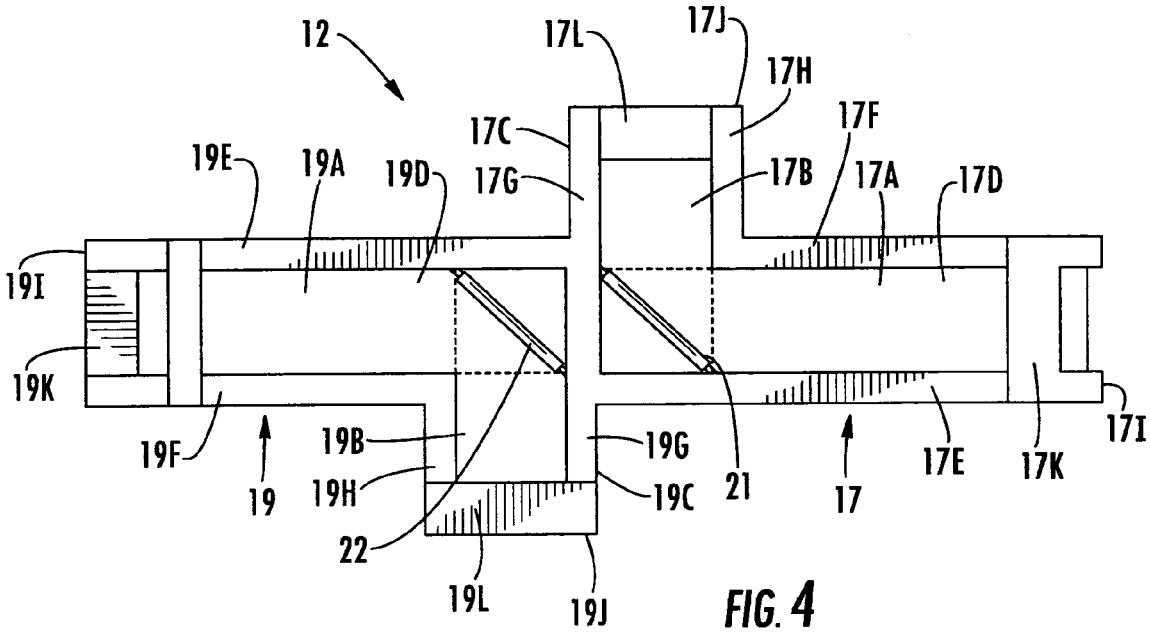
FIG. 4 shows another direction-changing bracket used to secure and provide a direction-change of the strap of the book carrying apparatus.

FIG. 4 illustrates the direction-changing bracket 12 in detail. The direction-changing bracket 12 has a unitary construction which includes an upper L-shaped section 17 and a lower inverted L-shaped section 19. Each of the L-shaped sections 17 and 19 includes a vertical section 17A and 19A, respectively and a horizontal section 17B and 19B, respectively. The upper and lower L-shaped sections 17 and 19 are joined along a lower end 17C of the upper L-shaped section 17 and an upper end 19C of the lower inverted L-shaped section 19. Each of the L-shaped sections 17 and 19 has a channel 17D and 19D, respectively defined by raised sides. Each of the L-shaped sections 11 and 19 respectively include a long vertical raised side 17E and 19E, a short vertical raised side 17F and 19F, a long horizontal raised side 17G and 19G, and a short horizontal raised side 17H and 19H.

The direction-changing bracket 12 also includes guides 21 and 22 positioned within the channels 11D and 17D. The guides 21 and 22 are positioned diagonally, at an angle of approximately 45 degrees, between the long vertical raised sides 17E and 19E and the long horizontal raised sides 17G and 19G of each L-shaped section 17 and 19. As a result, the guides 21 and 22 are parallel to each other. The guides 21 and 22 are rounded elongate members. The guides 21 and 22, illustrated in FIG. 4, are rollers, however, the rounded elongate members may also be a rod, a pin, a bar, or any other suitable rounded elongate member. Additionally, the ends 17I, 17J, 19I, and 19J of each L-shaped section include strap retaining cross-members 17K, 17L, 19K, and 19L respectively to retain the elongate strap 11 within channels 17D and 19D of each of the L-shaped sections 17 and 19.

Figure 3:
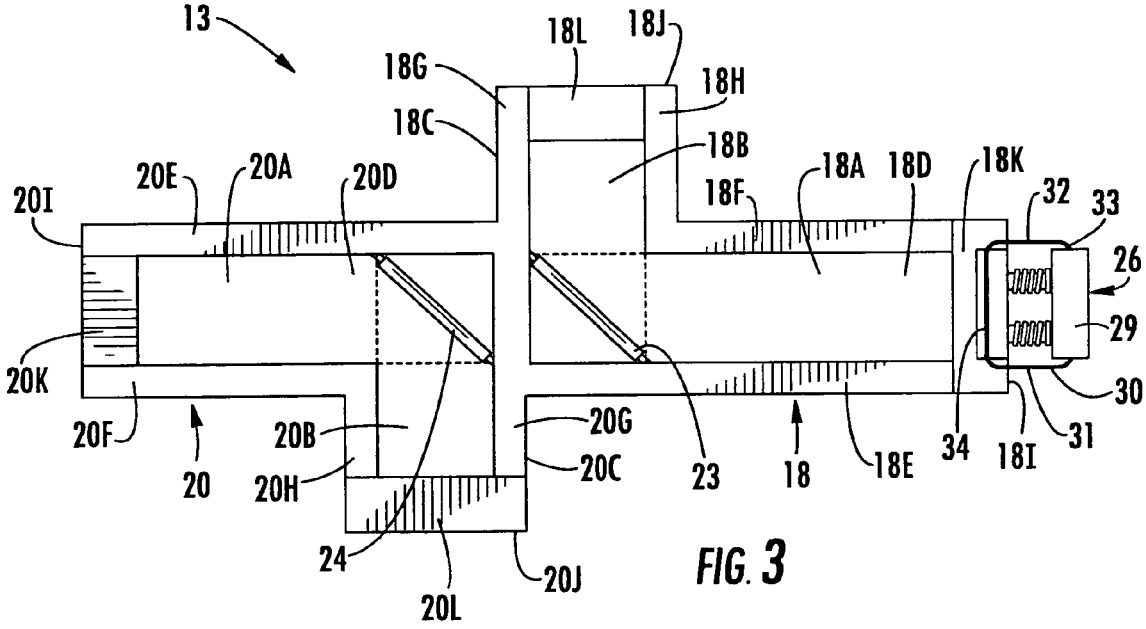
FIG. 3 shows a direction-changing bracket used to secure and provide a direction-change of a strap of the book carrying apparatus.

FIG. 3 illustrates the direction-changing bracket 13 in detail. The direction-changing bracket 13 has a unitary construction which includes an upper L-shaped section 18 and a lower inverted L-shaped section 20. Each of the L-shaped sections 18 and 20 includes a vertical section 18A and 20A, respectively and a horizontal section 18B and 20B, respectively. The upper and lower L-shaped sections 18 and 20 are joined along a lower end 18C of the upper L-shaped section 18 and an upper end 20C the lower inverted L-shaped section 20. Each of the L-shaped sections 18 and 20 has a channel 18D and 20D respectively, defined by raised sides. Each of the L-shaped sections 18 and 20 respectively include a long vertical raised side 18E and 20E, a short vertical raised side 18F and 20F, a long horizontal raised side 18G and 20G, and a short horizontal raised side 18H and 20H.

The direction-changing bracket 13 also includes guides 23 and 24 positioned within the channels 18D and 20D. The guides 23 and 24 are positioned diagonally, at an angle of approximately 45 degrees, between the long vertical raised sides 18E and 20E and the long horizontal raised sides 18G and 20G of each L-shaped section 18 and 20. As a result, the guides 23 and 24 are parallel to each other. The guides 23 and 24 are rounded elongate members. The guides 23 and 24, illustrated in FIG. 3, are rollers, however, the rounded elongate members may also be a rod, a pin, a bar, or any other suitable rounded elongate member. Additionally, the ends 18I, 18J, 20I, and 20J of each L-shaped section include strap retaining cross-members 18K, 18L, 20K, and 20L respectfully to retain the elongate strap 11 within channels 18D and 20D of each of the L-shaped sections 18 and 20.

Figure 6:
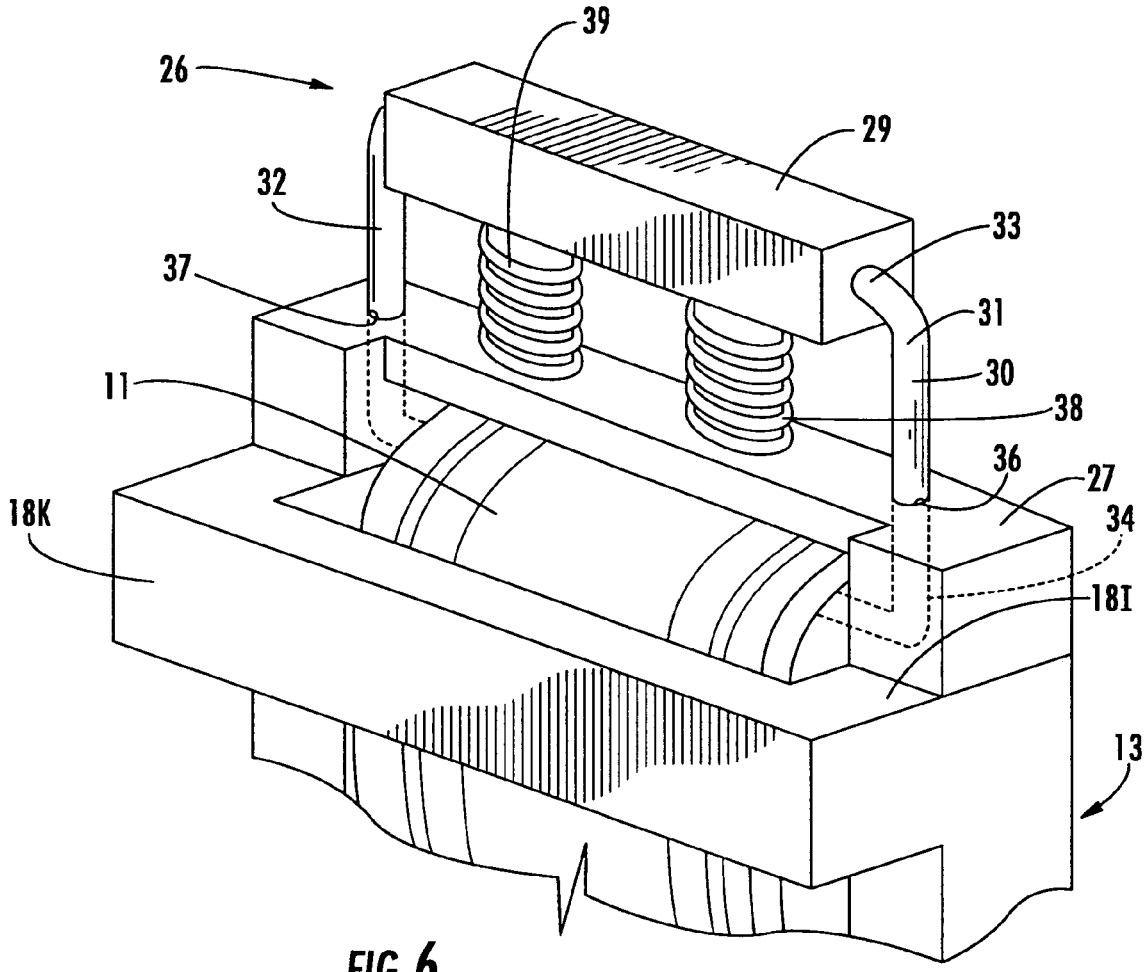
FIG. 6 shows a strap tensioner positioned at a top of one of the direction-changing brackets.

A spring-biased strap tensioner device 26 is positioned on an end plate 27 located on end 18I of the direction-changing brackets 13, and is shown in detail in FIG. 6. The strap tensioner device 26 includes a top plate 29 attached to a tension bar 30. The tension bar 30 has a rectilinear shape having a pair of side rails 31 and 32 and a top 33 and bottom 34 rail. The top rail 33 is positioned within the top plate 29 and the bottom rail 34 is positioned below the end plate 27 of the direction-changing brackets 12 and 13. The side rails 31 and 32 of the tension bar 30 protrude through holes 36 and 37 in the end plate 27 to allow the side rails 31 and 32 of the tension bar 30 to slide therethrough. A pair of springs 38 and 39 are positioned between the top plate 29 and the end plate 27 of the direction-changing brackets 12 and 13 to provide an upward force on the top plate 29 and tension bar 30. It should be understood that any suitable number of springs may be used to provide a desired upward force.

The carrying apparatus is used as follows. The direction-changing brackets 12 and 13 are positioned on a forward side 14 and a rear side 16 of the books "B" or other objects being carried (See FIGS. 1 and 2). A first end 40 of the elongate strap 11 is attached to strap retaining cross-member 19K by forming a loop around the strap retaining cross-member 19K with the first end 40 of the strap 11 and securing the first end 40 of the strap 11 to an adjacent portion of the strap 11 by a fastening means, such as stitching, snaps, or hook and loop fasteners.

A second end 41 of the strap 11 is inserted into end 17I of the forward direction-changing bracket 12 behind a strap retaining cross-member 17K and into a vertical channel 17D of the top L-shaped section 17 of the forward direction-changing bracket 12. The strap 11 is threaded through the channel 17D of the top L-shaped section 17 to the guide 21. The strap 11 is pulled underneath the guide 21 and then wrapped around the guide 21 causing the strap 11 to change from a vertical direction to a horizontal direction. This process is similar to that illustrated in FIG. 7. The strap 11 is then pulled through the channel 17D of the top L-shaped section 17 of the forward direction-changing bracket 12 and underneath strap retaining cross-member 17L before exiting the forward direction-changing bracket 12.

The strap 11 exits the forward direction-changing bracket 12 and is wrapped around a side of the books "B" being carried and inserted into end 20J of the rear direction-changing bracket 13 behind strap retaining cross-member 20L and into channel 20D of the bottom L-shaped section 20 of the rear direction-changing bracket 13. The strap 11 is threaded through channel 20D of the bottom L-shaped section 20 to the guide 24. The strap 11 is pulled over the top of the guide 24 and then wrapped around the guide 24 causing the strap 11 to change from a horizontal direction to a vertical direction. This process is similar to that illustrated in FIG. 7. The strap 11 is then pulled through channel 20D of the bottom L-shaped section 20 of the rear direction-changing bracket 13 and underneath strap retaining cross-member 20K before exiting the rear direction-changing bracket 13.

Figure 7:
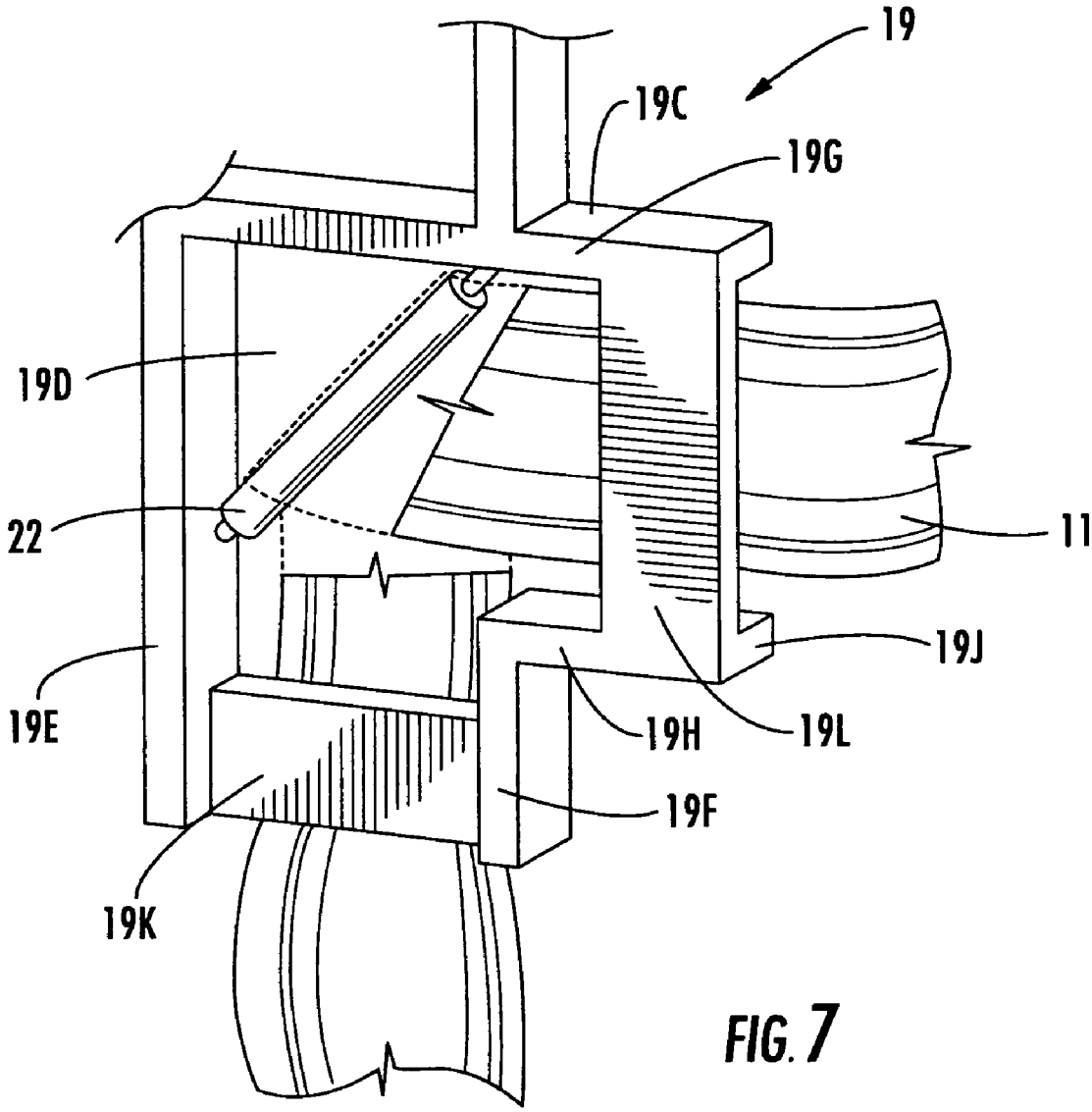
FIG. 7 shows the strap of the book carrying apparatus within one of the direction-changing brackets.

The strap 11 exits the rear direction-changing bracket 13 and is wrapped underneath the books "B" being carried and inserted into end 19I of the forward direction-changing bracket 12 behind strap retaining cross-member 19K and into channel 19D of the bottom L-shaped section 19 of the forward direction-changing bracket 13. The strap 11 is threaded through channel 19D of the bottom L-shaped section 19 to the guide 22. The strap 11 is pulled underneath the guide 22 and then wrapped around the guide 22 causing the strap 11 to change from a vertical direction to a horizontal direction, as illustrated in FIG. 7. The strap is then pulled through channel 19D of the bottom L-shaped section 19 of the forward direction-changing bracket 12 and underneath strap retaining cross-member 19L before exiting the forward direction-changing bracket 12.

The strap 11 exits the forward direction-changing bracket 12 and is wrapped around another side of the books "B" being carried and inserted into end 18J of the rear direction-changing bracket 13 behind strap retaining cross-member 18L and into channel 18D of the top L-shaped section 18 of the rear direction-changing bracket 13. The strap 11 is threaded through channel 18D of the top L-shaped section 18 to the guide 23. The strap 11 is pulled underneath the guide 23 and then wrapped around the guide 23 causing the strap 11 to change from a horizontal direction to a vertical direction. This process is similar to that illustrated in FIG. 7. The strap 11 is then pulled through channel 18D of the top L-shaped section 18 of the rear direction-changing bracket 13 and underneath strap retaining cross-member 18K.

The spring-biased strap tensioner 26 located on end 18I of the rear direction-changing bracket 13 is released by depressing the top plate 29 of the strap tensioner 26, allowing the strap 11 to be pulled through between the end plate 27 and the bottom rail 34 of the tension bar 30. Once the strap 11 has been pulled through the strap tensioner 26, the top plate 29 of the strap tensioner 26 is released allowing the springs 38 and 39 to provide an upward force on the top plate 29 which causes the bottom rail 34 of the tension bar 30 to engage the strap 11, causing the strap 11 to be sandwiched between the bottom rail 34 of the tension bar 30 and the end plate 27, securing the strap 11 in position.

The strap 11 is then stretched across a top end of the books "B" and pulled through a direction-changing bracket 12. It should be noted, however, that the strap tensioner can be positioned on the top end of either direction-changing bracket 12 or 13. Furthermore, a strap tensioner may be mounted on each direction changing bracket if desired.

The shoulder strap 11A of the book carrying apparatus is adjusted by depressing the top plate 29 of the strap tensioner 26 and pulling the strap 11 through the direction-changing brackets 12 and 13 until the desired shoulder strap length is achieved. Once the shoulder strap 11A is properly sized, the top plate 29 of the strap tensioner 26 is released to allow the bottom rail 34 of the strap tensioner 26 to engage the strap 11, securing the strap 11 in position.

Figure 5:
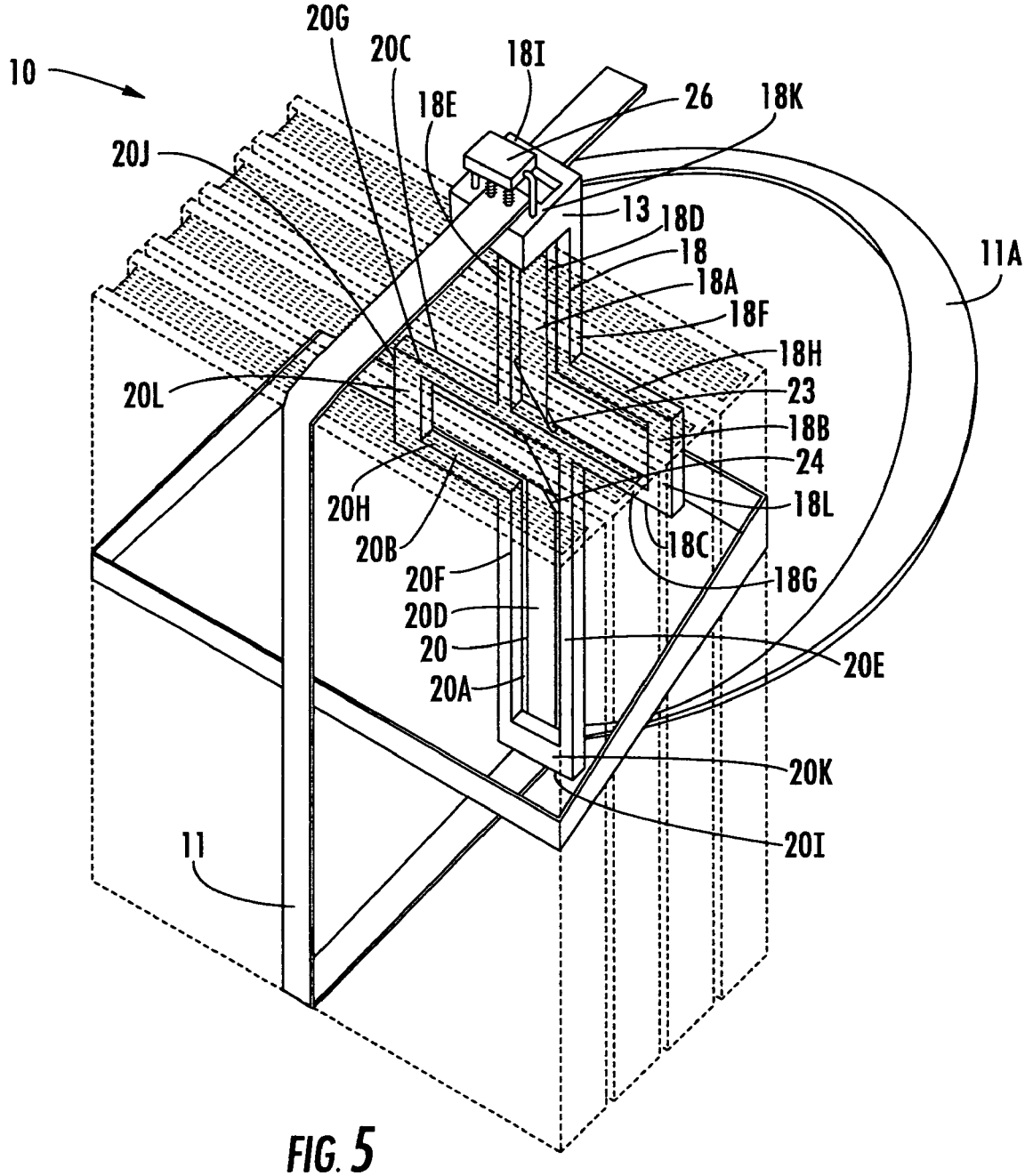
FIG. 5 shows a perspective view of a book carrying apparatus using a single direction-changing bracket in accordance with the present invention.

The carrying apparatus 10 may also be used with only one direction-changing bracket 13 positioned on a side of the books "B", as illustrated in FIG. 5. As described above, the first end 40 of the elongate strap 11 is attached to strap retaining cross-member 20K by forming a loop around the strap retaining cross-member 20K with the first end 40 of the strap 11 and securing the first end 40 of the strap 11 to an adjacent portion of the strap 11 by a fastening means, such as stitching, snaps, or hook and loop fasteners.

The second end 41 of the strap 11 is inserted into end 18I of the direction-changing bracket 13 behind a strap retaining cross-member 18K and into a vertical channel 18D of the top L-shaped section 18 of the direction-changing bracket 13. The strap 11 is threaded through the channel 18D of the top L-shaped section 18 to the guide 23. The strap 11 is pulled underneath the guide 23 and then wrapped around the guide 23 causing the strap 11 to change from a vertical direction to a horizontal direction. The strap 11 is then pulled through the channel 18D of the top L-shaped section 18 of the direction-changing bracket 13 and underneath strap retaining cross-member 18L before exiting the direction-changing bracket 13.

The strap 11 exits the direction-changing bracket 13 and is wrapped around three sides of the books "B" being carried and inserted into end 20J of the direction-changing bracket 13 behind strap retaining cross-member 20L and into channel 20D of the bottom L-shaped section 20 of the direction-changing bracket 13. The strap 11 is threaded through channel 20D of the bottom L-shaped section 20 to the guide 24. The strap 11 is pulled over the top of the guide 24 and then wrapped around the guide 24 causing the strap 11 to change from a horizontal direction to a vertical direction. The strap 11 is then pulled through channel 20D of the bottom L-shaped section 20 of the direction-changing bracket 13 and underneath strap retaining cross-member 20K before exiting the direction-changing bracket 13.

The strap exits the direction-changing bracket 13 and is wrapped around the bottom of the books "B" to the top of the books "B". The strap 11 is then stretched across the top of the books to the spring-biased strap tensioner 26. The strap tensioner 26 then secures the strap 11 in position as described above.

A carrying apparatus is described above. Various details of the invention may be changed without departing from its scope. Furthermore, the foregoing description of the preferred embodiments of the invention and the best mode for practicing the invention are provided for the purpose of illustration only and not for the purpose of limitation, the invention being identified in the claims.

I claim:

1. A carrying apparatus, comprising:

(a) at least one direction-changing bracket for being positioned on a side of an object; and (b) an elongate strap for being wrapped around said object, wherein said strap is threaded through said direction-changing bracket to form a pocket for receiving and securing the object in a carrying position;

(c) wherein said direction-changing bracket is defined by a first L-shaped section and an attached second inverted L-shaped section; and (d) wherein each of said L-shaped sections include a vertical section and a horizontal section, and at least one guide is disposed at the intersection of said vertical and horizontal sections, said guide being disposed at an angle which allows said strap to change directions without binding.

2. The carrying apparatus according to claim 1, further including a securing means for securing said strap in a selected position relative to said direction changing bracket.

3. The carrying apparatus according to claim 2, wherein the securing means includes a movable bar for clamping said strap against an end plate.

4. The carrying apparatus according to claim 1, wherein the securing means further includes a top plate, at least one spring, and the bar attached to the top plate, and wherein the at least one spring is positioned between the top plate and an end plate of the direction-changing [bracket] for providing an upward force on the top plate forcing the bar to engage the strap and securing the strap.

5. The carrying apparatus according to claim 1, wherein said guide is selected from the group consisting of a roller, a rod, a pin, and a bar.

6. The carrying apparatus according to claim 1, wherein said strap forms a loop around said guide to define first and second mutually perpendicular strap sections.

7. The carrying apparatus according to claim 1, wherein said direction-changing bracket includes a plurality of cross-members which define a channel for receiving said strap.

8. The carrying apparatus according to claim 1, wherein said strap is positioned relative to said direction-changing bracket to define a shoulder loop for allowing an individual to carry the carrying apparatus over a shoulder.

9. A carrying apparatus, comprising:

(a) at least two spaced-apart direction-changing devices for being positioned on opposing sides of an object; and (b) an elongate strap for being wrapped around said object, wherein said strap is threaded through said direction-changing devices to form a pocket for receiving and securing the object in a carrying position;

(c) wherein said direction-changing devices are defined by a first L-shaped section and an attached second inverted L-shaped section; and (d) wherein each of said L-shaped sections include a vertical section and a horizontal section, and at least one guide is disposed at the intersection of said vertical and horizontal sections, said guide being disposed at an angle which allows said strap to change directions without binding.

10. The carrying apparatus according to claim 9, further including a tensioner for securing said strap in a selected position relative to said direction changing device.

11. The carrying apparatus according to claim 10, wherein the tensioner includes a movable bar for clamping said strap against an end plate.

12. The carrying apparatus according to claim 11, wherein the tensioner further includes a top plate, at least one spring, and a bar attached to the top plate, and wherein the at least one spring is positioned between the top plate and an end plate of a respective one of the at least two spaced-apart direction-changing devices for providing an upward force on the top plate forcing the bar to engage the strap and securing the strap.

13. The carrying apparatus according to claim 9, wherein said guide is selected from the group consisting of a roller, a rod, a pin, and a bar.

14. The carrying apparatus according to claim 9, wherein said strap forms a loop around said guide to define first and second mutually perpendicular strap sections.

15. The carrying apparatus according to claim 9, wherein said direction-changing devices include a plurality of cross-members which define a channel for receiving said strap.

16. The carrying apparatus according to claim 9, wherein said strap is positioned relative to said direction-changing devices to define a shoulder loop for allowing an individual to carry the carrying apparatus over a shoulder.

* * * * *